US009628892B2

(12) United States Patent
Uhm et al.

(10) Patent No.: US 9,628,892 B2
(45) Date of Patent: Apr. 18, 2017

(54) METHOD OF DETERMINING OPERATION MODE OF HEARING DEVICE AND HEARING DEVICE

(71) Applicant: Samsung Electronics Co., Ltd., Suwon-si (KR)

(72) Inventors: Jun Whon Uhm, Anyang-si (KR); Jong Jin Kim, Hwaseong-si (KR); Yun Seo Ku, Seoul (KR); Dong Wook Kim, Seoul (KR); Jun Il Sohn, Yongin-si (KR); Heun Chul Lee, Pocheon-si (KR); Jong Min Choi, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 177 days.

(21) Appl. No.: 14/108,554

(22) Filed: Dec. 17, 2013

(65) Prior Publication Data

US 2014/0205118 A1 Jul. 24, 2014

(30) Foreign Application Priority Data

Jan. 24, 2013 (KR) ..... 10-2013-0008180

(51) Int. Cl.

*H04R 1/10* (2006.01)
*H04R 3/00* (2006.01)
*H04R 25/00* (2006.01)

(52) U.S. Cl.

CPC ..... *H04R 1/1041* (2013.01); *H04R 3/005* (2013.01); *H04R 25/43* (2013.01); *H04R 25/70* (2013.01)

(58) Field of Classification Search

CPC ..... H04R 2225/021; H04R 2225/55; H04R 25/55; H04R 25/30; H04R 25/505; H04R 25/502; H04R 25/00; H04R 25/70
USPC ..... 381/312, 23.1, 60, 314
See application file for complete search history.

(56) References Cited

U.S. PATENT DOCUMENTS 5,710,819 A 1/1998 Tøpholm et al.
5,910,997 A * 6/1999 Ishige ..... H04R 25/505 381/312
7,106,870 B2 * 9/2006 Meier ..... H04R 25/43 381/314
7,545,944 B2 * 6/2009 Allegro Baumann ..... H04R 25/552 381/23.1
8,705,782 B2 * 4/2014 Woods ..... H04R 25/558 381/315
8,798,296 B2 * 8/2014 Schmitt ..... H04R 25/70 381/109
8,831,256 B2 * 9/2014 Fort ..... A61N 1/36032 307/104

(Continued)

FOREIGN PATENT DOCUMENTS

JP 2004-032275 1/2004
JP 2010-263567 11/2010

(Continued)

*Primary Examiner* — Davetta W Goins
*Assistant Examiner* — Oyesola C Ojo
(74) *Attorney, Agent, or Firm* — Staas & Halsey LLP

(57) ABSTRACT

A method of determining an operation mode of a hearing device and the hearing device may include detecting an input signal of the hearing device, determining the operation mode of the hearing device by determining whether the input signal is a designated signal related to a programming mode of the hearing device, and controlling the hearing device according to the operation mode.

16 Claims, 4 Drawing Sheets

(56) References Cited

U.S. PATENT DOCUMENTS

| | | | | |
|---|---|---|---|---|
| 2002/0094098 | A1* | 7/2002 | Delage | H04R 25/55 381/312 |
| 2005/0281424 | A1* | 12/2005 | Rass | H04R 25/70 381/312 |
| 2007/0076909 | A1* | 4/2007 | Roeck | H04R 25/70 381/312 |
| 2007/0127749 | A1* | 6/2007 | Menzl | H04R 25/30 381/312 |
| 2010/0158262 | A1* | 6/2010 | Schumaier et al. | 381/60 |
| 2011/0142273 | A1* | 6/2011 | Iwano | H04R 25/70 381/321 |

FOREIGN PATENT DOCUMENTS

| | | |
|---|---|---|
| KR | 10-2004-0087505 | 10/2004 |
| KR | 10-2005-0049977 | 5/2005 |
| KR | 10-2006-0071906 | 6/2006 |
| KR | 10-2007-0080429 | 8/2007 |
| KR | 10-2008-0063936 | 7/2008 |
| KR | 10-2008-0086639 | 9/2008 |
| KR | 10-2011-0111752 | 10/2011 |
| KR | 10-2012-0002737 | 1/2012 |

* cited by examiner

METHOD OF DETERMINING OPERATION MODE OF HEARING DEVICE AND HEARING DEVICE

CROSS-REFERENCE TO RELATED APPLICATIONS

This application claims the priority benefit of Korean Patent Application No. 10-2013-0008180, filed on Jan. 24, 2013, in the Korean Intellectual Property Office, the disclosure of which is incorporated herein by reference.

BACKGROUND

1. Field

The following description relates to a method of determining an operation mode of a hearing device and the hearing device, and more particularly, to a method of determining an operation mode of a hearing device by identifying an input signal being detected and the hearing device.

2. Description of the Related Art

A hearing device helps a user wearing the hearing device hear an ambient sound of the user clearly. To transmit the ambient sound correctly to the user, the hearing device should set a program to an optimal state for the user.

In general, a parameter, a volume, a gain per frequency, and the like of the hearing device are set using a digital signal processor (DSP) provided in the hearing device or a dedicated device for setting the hearing device. Here, according to the method using the dedicated device, the dedicated device is used in addition to the hearing device. Therefore, additional cost is incurred to connect the dedicated device with the hearing device. Thus, it may be cumbersome for the user to use the hearing device because additional time and cost are required for setting up the hearing device.

In addition, the dedicated device may be complicated or difficult for the user to handle. Therefore, a skilled engineer may be necessary for setting of the hearing device.

SUMMARY

The foregoing and/or other aspects are achieved by providing a method of determining an operation mode of a hearing device, the method including detecting an input signal of the hearing device, determining the operation mode of the hearing device by determining whether the input signal is a designated signal related to a programming mode of the hearing device, and controlling the hearing device according to the operation mode.

The detecting may include detecting an input signal corresponding to an output signal of an external terminal.

The detecting may include detecting an input signal including a pure tone indicating a single frequency or a complex tone in which at least two pure tones indicating different frequencies are mixed.

The detecting may include detecting an input signal according to intensity of a sound including the pure tone or the complex tone.

The determining may include comparing a code of the input signal to a code of the designated corresponding to at least one programming mode.

The determining may include determining whether the input signal is a designated signal for changing an algorithm included in the hearing device.

The determining may include determining the operation mode of the hearing device by determining whether the input signal is a designated signal for setting parameters of the hearing device.

The determining may include determining the operation mode of the hearing device by determining whether the input signal is a designated for upgrading firmware of the hearing device.

The determining may include determining the operation mode of the hearing device to be a programming mode for programming the hearing device when the input signal is the designated signal, and determining the operation mode of the hearing device to be a general mode for compensating a hearing loss when the input signal is not the designated signal.

The controlling may include controlling the hearing device by converting the operation mode of the hearing device into the programming mode or the general mode according to a result of the determining.

The foregoing and/or other aspects are achieved by providing a hearing device including a detection unit to detect an input signal of the hearing device, a determination unit to determine an operation mode of the hearing device by determining whether the input signal is a designated signal related to a programming mode of the hearing device, and a control unit to control the hearing device according to the operation mode.

The detection unit may detect an input signal corresponding to an output signal of an external terminal.

The detection unit may detect an input signal including a pure tone indicating a single frequency or a complex tone in which at least two pure tones indicating different frequencies are mixed.

The detection unit may detect an input signal according to intensity of a sound including the pure tone or the complex tone.

The determination unit may compare a code of the input signal to a code of the designated corresponding to at least one programming mode.

The determination unit may determine whether the input signal is a designated signal for changing an algorithm included in the hearing device.

The determination unit may determine the operation mode of the hearing device by determining whether the input signal is a designated signal for setting parameters of the hearing device.

The determination unit may determine the operation mode of the hearing device by determining whether the input signal is a designated for upgrading firmware of the hearing device.

The determination unit may determine the operation mode of the hearing device to be a programming mode for programming the hearing device when the input signal is the designated signal, and determines the operation mode of the hearing device to be a general mode for compensating a hearing loss when the input signal is not the designated signal.

The control unit may control the hearing device by converting the operation mode of the hearing device into the programming mode or the general mode according to a determination result.

Additional aspects, features, and/or advantages of example embodiments will be set forth in part in the description which follows and, in part, will be apparent from the description, or may be learned by practice of the disclosure.

BRIEF DESCRIPTION OF THE DRAWINGS

These and/or other aspects and advantages will become apparent and more readily appreciated from the following description of the example embodiments, taken in conjunction with the accompanying drawings of which.

DETAILED DESCRIPTION

Figure 1:
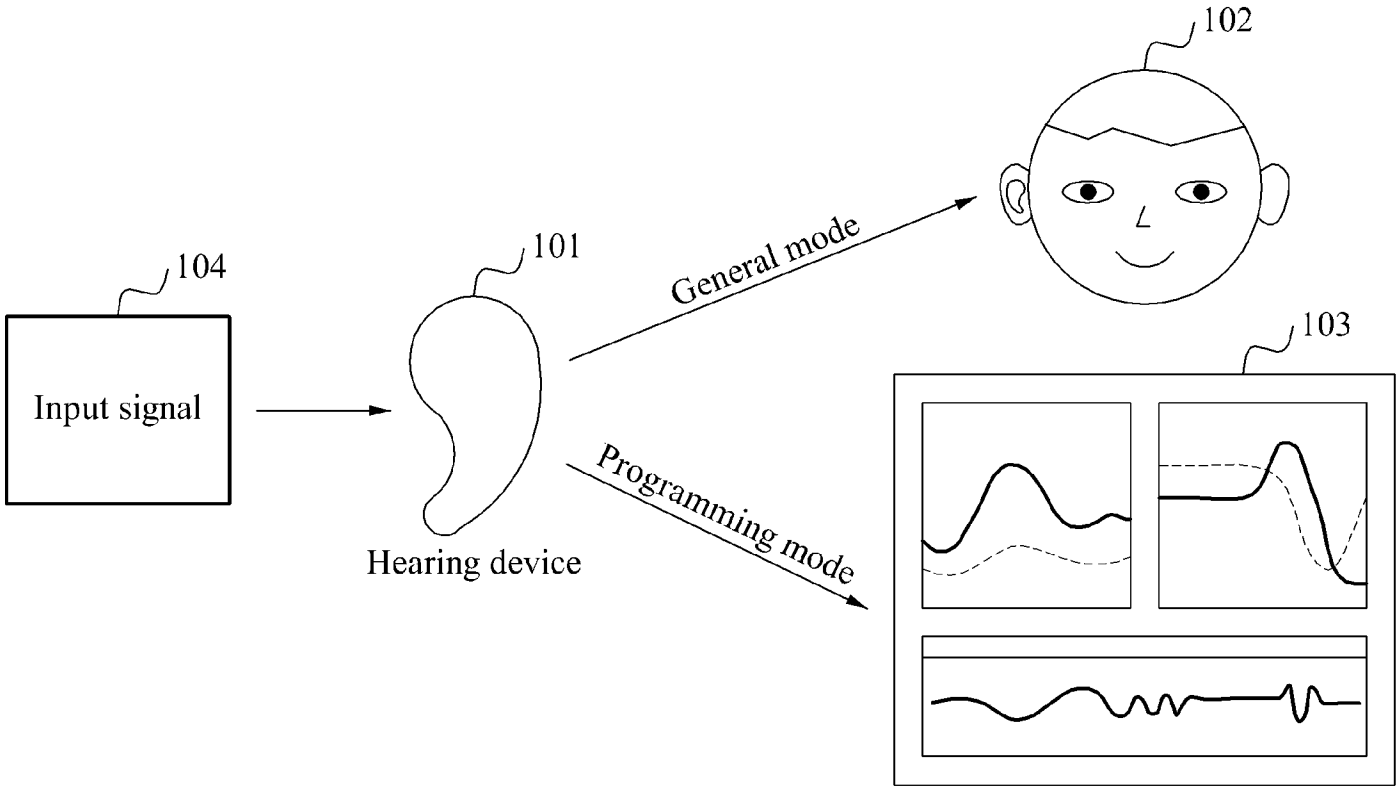
FIG. 1 illustrates a process of controlling a mode of a hearing device according to an input signal, according to example embodiments.

Reference will now be made in detail to example embodiments, examples of which are illustrated in the accompanying drawings, wherein like reference numerals refer to like elements throughout. Example embodiments are described below to explain the present disclosure by referring to the figures.

FIG. 1 illustrates a process of controlling a mode of a hearing device 101 according to an input signal, according to example embodiments.

Referring to FIG. 1, when a user wears the hearing device 101, the hearing device 101 may detect an input signal 104 including an audio signal, an external audio signal not generated from the user, or an output signal of an external terminal located around the hearing device. The hearing device 101 may determine whether the input signal 104 being detected is a designated signal that is preset to the hearing device 101. The designated signal may correspond to a programming mode of the hearing device 101.

The hearing device 101 may determine an operation mode of the hearing device 101 according to a determination result about the input signal. For example, the hearing device 101 may determine whether the input signal is the designated signal corresponding to the programming mode, by detecting the audio signal or the output signal of the external terminal. Therefore, the hearing device 101 may determine the operation mode of the hearing device 101 corresponding to a general mode 102 or a programming mode 103 of the hearing device 101.

In detail, the hearing device 101 may determine the operation mode according to a result of determining whether the input signal 104 is the designated signal related to the programming mode of the hearing device 101, and control the hearing device 101 based on the operation mode. The hearing device may select an operation mode, corresponding to a general mode or a programming mode, based on the designated signal.

In this case, the hearing device 101 is programmed according to the designated signal. Therefore, the user may use the hearing device 101 more conveniently without having to use a dedicated device for programming the hearing device 101. Here, the user may convert the operation mode of the hearing device by a simple method. For example, the user may generate an input signal such as the audio signal and the output signal of the external terminal, according to a predetermined designated signal. Also, the user may prepare an input signal in advance according to the designated signal and reproduce the prepared input signal when converting the operation mode of the hearing device 101.

Figure 2:
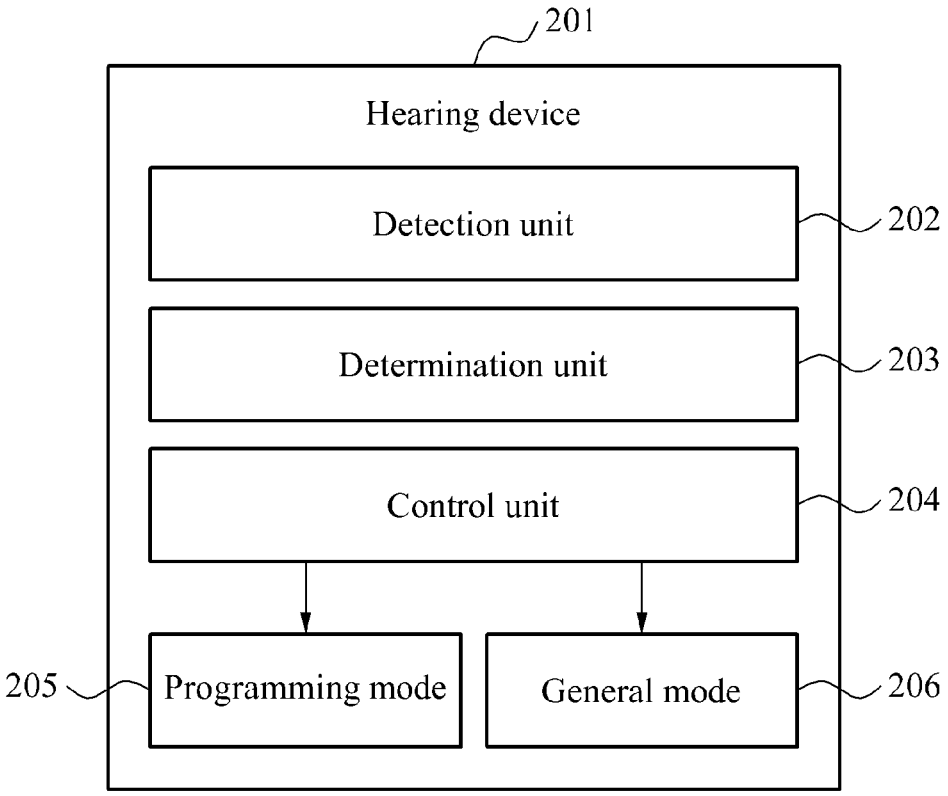
FIG. 2 illustrates a detailed structure of a hearing device, according to example embodiments.

FIG. 2 illustrates a detailed structure of a hearing device 201, according to example embodiments.

Referring to FIG. 2, the hearing device 201 may include a detection unit 202, a determination unit 203, and a control unit 204.

The detection unit 202 may detect a sound generated outside the device. That is, the detection unit 202 may detect a sound such as an audio signal, an output signal of an external terminal located around the device, and the like. The detected sound may be an input signal detected by the hearing device 201. For example, the detection unit 202 may detect the input signal through a microphone disposed at an inside or an outside of the hearing device 201. However, the disclosure is not limited thereto, and the detection unit 202 may detect the input signal by various other methods.

The detection unit 202 may detect the input signal which includes a pure tone or a complex tone. The pure tone may refer to a sound corresponding to a single frequency. The complex tone may refer to a sound in which at least two pure tones of different frequencies are mixed.

The audio signal and the output signal of the external terminal may include the pure tone or the complex tone. For example, the audio signal and the output signal of the external terminal may be a signal related to the operation mode of the hearing device 201, that is, the input signal including a pure tone or a mixed sound related to determination of the operation mode.

In other words, the detection unit 202 may detect the input signal capable of determining the operation mode of the hearing device 201. Here, the user may generate the input signal including a series of pure tones or complex tones to determine the operation mode of the hearing device 201. In addition, the user may generate the input signal more easily by using a predetermined audio signal or output signal of the external terminal.

In addition, the detection unit 202 may detect the input signal according to an intensity of a sound including the pure tone or the complex tone. For example, the detection unit 202 may detect the input signal of different operation modes according to an intensity of the pure tone.

The determination unit 203 may determine whether the input signal is the designated signal. The designated signal may be the signal related to the programming mode of the hearing device 201, as a reference signal for determining the input signal.

The determination unit 203 may compare a code of the input signal to a code of the designated signal. Here, the code of the input signal may be a code converted corresponding to the input signal such as a predetermined sound signal, or a predetermined time interval signal, for example. The predetermined sound signal and the predetermined time interval signal may be a signal having a uniform delay, or a signal in which predetermined frequencies are mixed, for example. For example, the code of the input signal may be an input signal including sounds of musical scales of Do, Re, Mi, Fa, and Sol, or a binary code '10101110' converted corresponding to an input signal for generating a sound of a musical scale of 'Do' for 4 seconds. That is, the code of the input signal may refer to a specific input signal for programming the hearing device 201.

The code of the designated signal may correspond to at least one programming mode. For example, the code of the designated signal may relate to an operation programmed in the programming mode of the hearing device 201 according to the designated signal generated by a duration of 1 second and a frequency of 10 hertz.

The determination unit 203 may determine the operation mode of the hearing device 201 according to the determination result with respect to the input signal. The operation mode of the hearing device 201 may include a general mode 206 and a programming mode 205. The general mode 206, as a basic operation mode of the hearing device 201, may process the input signal and output a processing result. For example, the general mode 206 may refer to the day-to-day operation of the hearing device 201. That is, the general mode 206 may be a mode for transmitting an external sound to the user. In addition, the general mode 206 may prevent the operation mode from being converted unintentionally during use of the hearing device 201. That is, the determination unit 203 may determine the operation mode to be the programming mode according to whether the input signal is the designated signal. When the input signal is not the designated signal, the determination unit 203 may determine the operation mode to be the general mode 206.

The programming mode 205 may be the programming mode for setting the hearing device 201 in relation to control of the hearing device 201.

For example, the determination unit 203 may determine the operation mode of the hearing device 201 by determining whether the input signal is the designated signal for converting an algorithm included in the hearing device 201. Here, the designated signal for converting the algorithm included in the hearing device 201 may be a signal for converting a base algorithm of the hearing device 201 stored in a memory of the hearing device 201 into a new algorithm.

As an example, the determination unit 203 may determine the operation mode by determining whether the input signal is the designated signal for setting a parameter of the hearing device 201. The designated signal for setting the parameter of the hearing device 201 may be a signal for setting parameters of the hearing device 201, including volume control, power control, echo control, equalizer control, reverberation control, and wind noise control, for example.

As an example, the determination unit 203 may determine the operation mode of the hearing device 201 by determining whether the input signal is a designated signal for converting a parameter of an algorithm for fitting of the hearing device 201. Here, the designated signal for converting the parameter of the algorithm for fitting of the hearing device 201 may be a signal for converting the parameter of the algorithm stored in the memory in consideration of a sound perception degree of the user, such as a hearing loss of the user, for example.

As an example, the determination unit 203 may determine the operation mode of the hearing device 201 by determining whether the input signal is a designated signal for upgrading firmware of the hearing device 201. The designated signal for upgrading firmware of the hearing device 201 may be a signal for upgrading the firmware included in the hearing device 201.

As an example, the determination unit 203 may determine the operation mode of the hearing device 201 by determining whether the input signal is a designated signal for correcting a sound of the input signal detected by the hearing device 201. Here, the signal for correcting the sound of the input signal may be a signal for correcting a sound of a microphone that receives the input signal to correctly detect the input signal.

In addition, the determination unit 203 may determine the operation mode in various other methods besides the above example methods.

Because the hearing device 201 determines the operation mode of the hearing device 201 according to the input signal, the user of the hearing device 201 may be able to program the hearing device 201 conveniently and easily.

The control unit 204 may include the programming mode 205 and the general mode 206. The control unit 204 may control the hearing device 201 according to the operation mode being converted. When the operation mode of the hearing device 201 is converted to the general mode 206, the control unit 204 may control the hearing device 201 to perform a basic operation. In addition, the control unit 204 may process the input signal, such as for compensation for a hearing loss, for example, and provide the processed input signal to the user. In this case, when the operation mode of the hearing device 201 is converted to the general mode 206, the input signal may not be the predetermined signal. Here, the predetermined signal may be the designated signal corresponding to the programming mode of the hearing device 201.

When the operation mode is converted to the programming mode 205, the control unit 204 may control the hearing device 201 according to the programming mode 205. The control unit 204 may control the hearing device 201 corresponding to various programming modes such as parameter setting, firmware upgrade, changing the algorithm stored in the memory, or setting of an algorithm for fitting of the hearing device 201 according to user demands, for example.

In addition, when the operation mode of the hearing device 201 is converted to the programming mode 205, the input signal may be the predetermined signal. When predetermined signals are no longer detected after the control unit 204 programs the hearing device 201 according to the programming mode 205, the control unit 204 may control the hearing device 201 to operate as a general hearing device. However, the disclosure is not limited thereto. For example, the predetermined signal may include a termination signal to end the programming mode and convert the hearing device 201 to operate as a general hearing device.

In detail, when the input signal is the predetermined signal according to the operation mode of the hearing device 201, programming of the hearing device 201 is performed. When the input signal is not the predetermined signal, the hearing device 201 may operate normally as a hearing device.

After the hearing device 201 is programmed according to the programming mode corresponding to the designated signal, a register of the hearing device 201 may be reset. The hearing device 201 may determine the operation mode by determining whether a next detected input signal is the designated signal. That is, the hearing device 201 may repeat processes of detecting the input signal, determining the designated signal, determining the operation mode of the hearing device, and controlling the hearing device 201.

Figure 3:
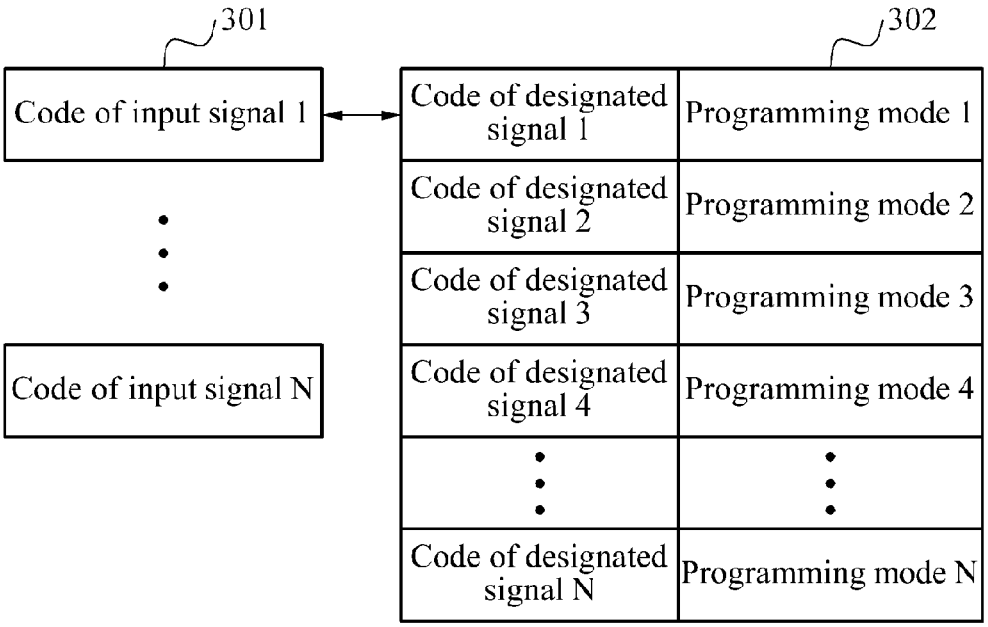
FIG. 3 illustrates a method of comparing a code of an input signal to a code of a designated signal corresponding to a programming mode, according to example embodiments.

FIG. 3 illustrates a method of comparing a code 301 of an input signal to a code 302 of a designated signal corresponding to a programming mode, according to example embodiments.

Referring to FIG. 3, the code 301 of the input signal may be compared to the code 302 of the designated signal corresponding to at least one programming mode. The code 301 of the input signal may be plural. The code 301 of the input signal may be a code converted from an input signal including different pure tones or a complex tone.

The code 302 of the designated signal may include codes of different designated signals according to the programming mode of the hearing device. For example, the code 302 of the designated signal may be a code converted corresponding to a programming mode for changing parameters of the hearing device. Therefore, the code 302 of the designated signal may be plural corresponding to the programming mode of the hearing device.

When the code 301 of the input signal is detected, the hearing device may compare the code 301 of the input signal with the code 302 of the designated signal. In detail, the hearing device may check whether the code 301 of the input signal is included in the code 302 of the designated signal corresponding to at least one programming mode.

Therefore, when the code 301 of the input signal is the code 302 of the designated signal, the hearing device may be set to the programming mode corresponding to the code 302 of the designated signal. When the code 301 of the input signal is not the code 302 of the designated signal, the hearing device may be set to the general mode to operate normally as a hearing device.

That is, the hearing device may be set to the programming mode or the general mode according to whether the code of the input signal is the code of the designated signal.

Figure 4:
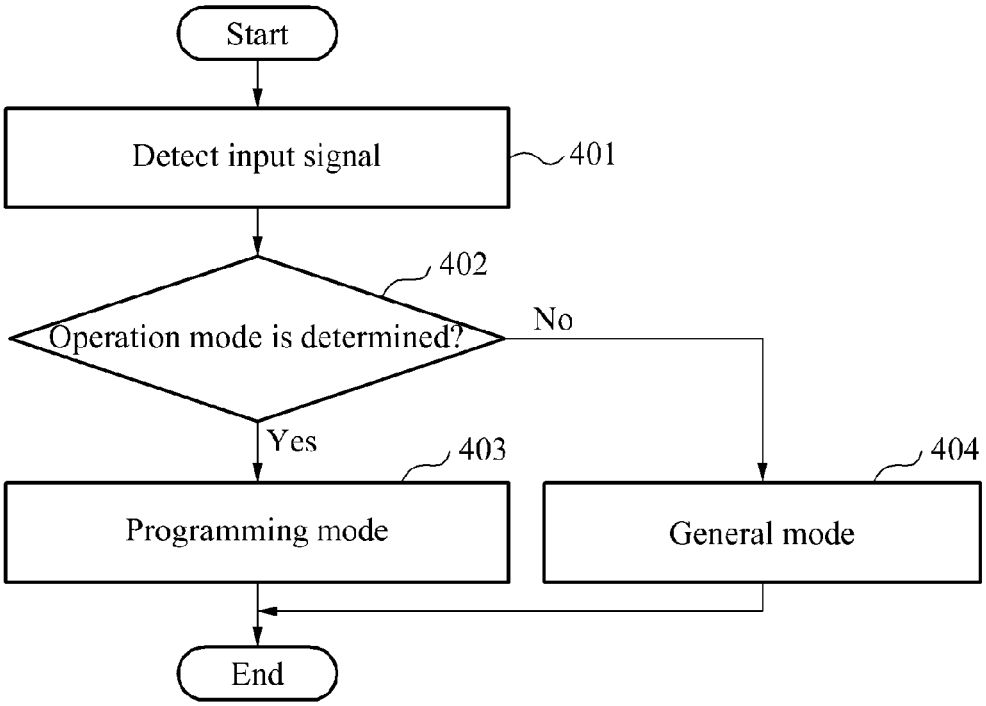
FIG. 4 illustrates a flowchart describing a method of determining an operation mode of a hearing device, according to example embodiments.

FIG. 4 illustrates a flowchart describing a method of determining an operation mode of a hearing device, according to example embodiments.

Referring to FIG. 4, in operation 401, the hearing device may detect an input signal. Here, the hearing device may detect the input signal through a microphone provided to the hearing device.

The hearing device may detect the input signal corresponding to an audio signal for determining the operation mode and an output signal of an external terminal. Also, the hearing device may detect the input signal including pure tones or complex tones.

In operation 402, the hearing device may determine whether the input signal is a designated signal. In addition, as a result of the determination, the hearing device may determine the operation mode. The hearing device may compare the input signal to a plurality of designated signals, thereby determining whether the input signal is the designated signal related to an operation signal for programming of the hearing device.

Accordingly, the hearing device may determine the operation mode of the hearing device as a general mode or a programming mode. That is, when the input signal is the designated signal, the hearing device may determine the connect mode to be the programming mode. When the input signal is not the designated signal, the hearing device may determine the connect mode to be the general mode.

In operation 403, the hearing device may be programmed according to the programming mode corresponding to the designated signal. Here, the programming mode may include a programming code for programming the hearing device. The hearing device may be programmed by the programming code included in the programming mode.

Thus, the hearing device may be programmed according to the programming mode such as parameter setting, firmware upgrade, change of the algorithm stored in a memory of the hearing device, or setting of an algorithm for fitting of the hearing device according to user demands, for example.

After the hearing device is programmed according to the programming mode corresponding to the designated signal, a register of the hearing device may be reset. In addition, the hearing device may be programmed according to a designated signal detected next. When designated signals are no longer detected, the hearing device may operate as a general hearing device.

In operation 404, in the general mode, the hearing device may operate as a general hearing device according to the determination result related to the input signal. In this case, the general mode may prevent the operation mode from being converted into the programming mode unintentionally during use. Here, the hearing device may process the input signal, for example, for compensation of a hearing loss, and provide the processed input signal to the user.

The above-described embodiments may be recorded in computer-readable media including program instructions to implement various operations embodied by a computer. The media may also include, alone or in combination with the program instructions, data files, data structures, and the like. The program instructions recorded on the media may be those specially designed and constructed for the purposes of embodiments, or they may be of the kind well-known and available to those having skill in the computer software arts. Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. The computer-readable media may also be a distributed network, so that the program instructions are stored and executed in a distributed fashion. The program instructions may be executed by one or more processors. The computer-readable media may also be embodied in at least one application specific integrated circuit (ASIC) or Field Programmable Gate Array (FPGA), which executes (processes like a processor) program instructions. Examples of program instructions include both machine code, such as produced by a compiler, and files containing higher level code that may be executed by the computer using an interpreter. The above-described devices may be configured to act as one or more software modules in order to perform the operations of the above-described embodiments, or vice versa.

Although example embodiments have been shown and described, it would be appreciated by those skilled in the art that changes may be made in these example embodiments without departing from the principles and spirit of the disclosure, the scope of which is defined in the claims and their equivalents.

What is claimed is:

1. A method of controlling a hearing device, the method comprising:

detecting input sound of the hearing device;

converting the input sound to a code of the input sound;

determining an operation mode of the hearing device based on whether the detected input sound is a designated sound related to at least one programming mode of the hearing device; and controlling the hearing device according to the operation mode, wherein the determining comprises:

comparing the code of the input sound to a code of the designated sound corresponding to the at least one programming mode to determine whether the input sound is the designated sound;

changing the operation mode of the hearing device to be the at least one programming mode for programming the hearing device based on a sound perception degree of a user when the detected input sound is the designated sound; and changing the operation mode from the at least one programming mode to a general mode for compensating a hearing loss when the detected input sound is other than the designated sound or the detected input sound is a termination sound, after the operation mode is changed from the general mode into the at least one programming mode.

2. The method of claim 1, wherein the input sound corresponds to an output sound of an external terminal.

3. The method of claim 1, wherein the input sound comprises a pure tone indicating a single frequency or a complex tone in which at least two pure tones indicating different frequencies are mixed.

4. The method of claim 3, wherein the detecting comprises detecting the input sound according to an intensity of a sound comprising the pure tone or the complex tone.

5. The method of claim 1, wherein the determining further comprises determining whether the detected input sound is a designated sound for changing an algorithm included in the hearing device.

6. The method of claim 1, wherein the determining further comprises determining the operation mode of the hearing device by determining whether the detected input sound is a designated sound for setting parameters of the hearing device.

7. The method of claim 1, wherein the determining further comprises determining the operation mode of the hearing device by determining whether the detected input sound is a designated sound for upgrading firmware of the hearing device.

8. The method of claim 1, wherein the controlling comprises controlling the hearing device by converting the operation mode of the hearing device into the at least one programming mode or the general mode according to a result of the determining.

9. A hearing device comprising:

a detection unit to detect an input sound of the hearing device;

a converting unit to convert the input sound to a code of the input sound;

a determination unit to determine an operation mode of the hearing device based on whether the detected input sound is a designated sound related to at least one programming mode of the hearing device; and a control unit to control the hearing device according to the operation mode, wherein:

the determination unit compares the code of the input sound to a code of the designated sound corresponding to the at least one programming mode to determine whether the input sound is the designated sound; and the control unit is further configured to:

change the operation mode of the hearing device to be the at least one programming mode for programming the hearing device based on a sound perception degree of a user when the detected input sound is the designated sound; and change the operation mode from the at least one programming mode to a general mode for compensating a hearing loss when the detected input sound is other than the designated sound or the detected input sound is a termination sound, after the operation mode is changed from the general mode into the at least one programming mode.

10. The hearing device of claim 9, wherein the input sound corresponds to an output sound of an external terminal.

11. The hearing device of claim 9, wherein the input sound comprises a pure tone indicating a single frequency or a complex tone in which at least two pure tones indicating different frequencies are mixed.

12. The hearing device of claim 11, wherein the detection unit detects the input sound according to intensity of a sound comprising the pure tone or the complex tone.

13. The hearing device of claim 9, wherein the determination unit determines whether the detected input sound is a designated sound for changing an algorithm included in the hearing device.

14. The hearing device of claim 9, wherein the determination unit determines the operation mode of the hearing device by determining whether the detected input sound is a designated sound for setting parameters of the hearing device.

15. The hearing device of claim 9, wherein the determination unit determines the operation mode of the hearing device by determining whether the detected input sound is a designated sound for upgrading firmware of the hearing device.

16. The hearing device of claim 9, wherein the control unit controls the hearing device by converting the operation mode of the hearing device into the at least one programming mode or the general mode according to the determination.

* * * * *